US005131965A

United States Patent [19]

McVicker

[11] Patent Number: 5,131,965

[45] Date of Patent: Jul. 21, 1992

[54] DEEP HARDENING STEEL ARTICLE HAVING IMPROVED FRACTURE TOUGHNESS

[75] Inventor: Joseph E. McVicker, Chillicothe, Ill.

[73] Assignee: Caterpillar Inc., Peoria, Ill.

[21] Appl. No.: 725,860

[22] Filed: Jul. 2, 1991

Related U.S. Application Data

[63] Continuation-in-part of Ser. No. 632,905, Dec. 24, 1990, abandoned.

[51] Int. Cl.[5] ..... C22C 38/22; C22C 38/28

[52] U.S. Cl. ..... 148/334; 420/110

[58] Field of Search ..... 148/334; 420/110, 111

[56] References Cited

U.S. PATENT DOCUMENTS 3,431,101 3/1969 Kunitake et al. ..... 420/111

4,790,977 12/1988 Daniels et al. ..... 420/104

FOREIGN PATENT DOCUMENTS 897576 10/1953 Fed. Rep. of Germany

*Primary Examiner*—Deborah Yee

*Attorney, Agent, or Firm*—Robert A. McFall

[57] ABSTRACT

A deep hardening steel has a composition comprising, by weight, about 0.26% to 0.37% carbon, about 0.5% to 1.0% manganese, about 1.0% to 3.0% silicon, about 1.5% to 2.5% chromium, about 0.3% to 1.0% molybdenum, from 0.05% to 0.2% vanadium, from 0.03% to 0.1% titanium, from 0.01% to 0.03% aluminum and at least 0.005% nitrogen. Also, the composition preferably contains less than about 0.025% each of phosphorus and sulfur. After quenching and tempering, articles made of this material are substantially free of aluminum nitrides, have a fine grained microstructure, and a combination of high hardness and fracture toughness.

The deep hardening steel article embodying the present invention is particularly useful for ground engaging tools that are subject to breakage and abrasive wear at high temperature.

10 Claims, 2 Drawing Sheets

DEEP HARDENING STEEL ARTICLE HAVING IMPROVED FRACTURE TOUGHNESS

This application is a continuation-in-part or U.S. application Ser. No. 07/632,905 filed Dec. 24, 1990, now abandoned and it is filed to correct errors in the parent application with respect to the reported magnification of certain metallurgical samples described herein.

TECHNICAL FIELD

This invention relates generally to a deep hardening steel, and more particularly to a deep hardening steel which, after heat treatment, has high hardness and fracture toughness.

BACKGROUND ART

Ground engaging tools, such as bucket teeth, ripper tips and cutting edges for construction machines operating in soil and rock, require a combination of high hardness throughout the tool to resist wear, high fracture toughness to avoid excessive tool breakage, and sufficient temper resistance to prevent loss of hardness during operation at elevated temperatures. A number of attempts have heretofore been made to provide a steel material having all of these characteristics.

A number of steel materials proposed for use in applications requiring a combination of desirable hardenability, toughness and temper resistance properties, have compositions which include relatively high amounts, i.e. above 3%, of chromium. For example, a steel mainly intended for use as an excavating tool edge material for construction machines is described in U.S. Pat. No. 3,973,951 issued Aug. 10, 1976 to K. Satsumabayashi et al. This steel has a chromium content of 3.0% to 6.0%. Similarly, a wear resisting steel developed for use as a ripper tip and having 3.0% to 5.0% chromium is described in Japanese Patent 54-42812 issued Dec. 17, 1979 to applicant Kabushiki Kaisha Komatsu Seisakusho. Another steel intended for use in mining buckets and other mineral processing operations, and having a composition that preferably includes 3% to 4.5% chromium, is described in U.S. Pat. No. 4,170,497 issued Oct. 9, 1979 to G. Thomas et al. The steel material embodying the present invention has high hardenability, toughness and temper resistance, but contains no more than 2.5% chromium, and preferably between 1.6% to 2.0% chromium.

Other steels intended for use in applications requiring a combination of high hardenability and toughness require significant amounts of nickel. Examples of these compositions are disclosed in U.S. Pat. No. 2,791,500 issued May 7, 1957 to F. Foley et al, U.S. Pat. No. 3,165,402 issued Jan. 12, 1965 to W. Finkl, U.S. Pat. No. 3,379,582 issued Apr. 23, 1968 to H. Dickinson and, more recently, U.S. Pat. No. 4,765,849 issued Aug. 23, 1988 to W. Roberts. The steel embodying the present invention does not require the presence of nickel to achieve the desired hardenability and toughness properties.

The above mentioned Roberts patent teaches the inclusion of aluminum and titanium in the steel composition, similar to that proposed by the present invention. However, Roberts adds substantially higher amounts of aluminum (0.4% to 1.0%) than that specified in the present invention, to intentionally form aluminum nitride in the solidified steel product.

Contrary to the teaching in the Roberts patent, it is generally recognized that the presence of aluminum nitride is undesirable in steel requiring high hardenability and toughness. For example, U.S. Pat. No. 3,254,991 issued Jun. 7, 1966 to J. Shimmin, Jr. et al and U.S. Pat. No. 4,129,442 issued Dec. 12, 1978 to K. Horiuchi et al specifically exclude aluminum from the steel composition to prevent the formation of aluminum nitrides.

The present invention is directed to overcoming the problems set forth above. It is desirable to have a deep hardening steel that has both high hardenability and toughness, has a composition that contains less than 3% chromium, does not require the addition of nickel and, after quenching and tempering, has a fine-grained microstructure that is free of aluminum nitrides.

DISCLOSURE OF THE INVENTION

In accordance with one aspect of the present invention, a deep hardening steel article has a composition that comprises, by weight percent, from 0.26 to 0.37 carbon, from 0.5 to 1.0 manganese, from 1.0 to 3.0 silicon, from 1.5 to 2.5 chromium, from 0.3 to 1.0 molybdenum, from 0.05 to 0.2 vanadium, from 0.03 to 0.1 titanium, from 0.01 to 0.03 aluminum, less than 0.025 phosphorous, less than 0.025 sulfur, at least 0.005 nitrogen, and the balance essentially iron. After quenching and tempering, the steel article is free of any aluminum nitride and has a grain size smaller than 0.06 mm (0.00236 in).

Other features of the deep hardening steel article include a steel article having the above composition and, after quenching and tempering, has a fracture toughness of at least 130 MPa$\sqrt{m}$ (118.3 ksi$\sqrt{in}$), and a hardness of at least $R_c$46 measured at the midpoint of a section having a thickness of no more than 25.4 mm in), or at 12.7 mm (0.5 in) below the surface of a section having a thickness greater than 25.4 mm in).

BEST MODE FOR CARRYING OUT THE INVENTION

Figure 1:
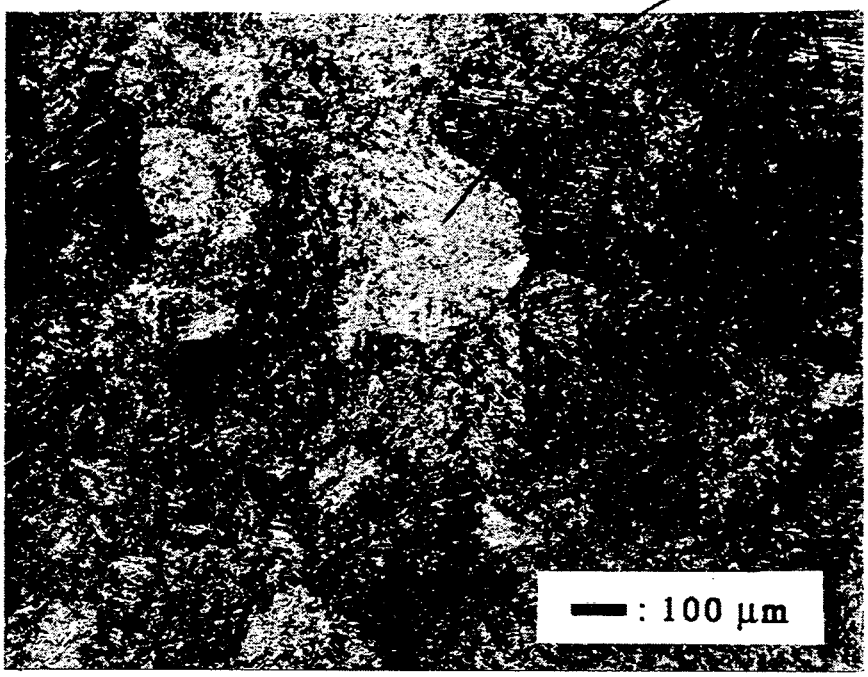
FIG. 1 is a photomicrograph, at 75X, of an etched section of a prior art deep hardening steel.

In the preferred embodiment of the present invention, a deep hardening steel has a composition comprising, by weight percent:

| | |
|---|---|
| carbon | 0.26 to 0.37 |
| manganese | 0.5 to 1.0 |
| silicon | 1.0 to 3.0 |
| chromium | 1.5 to 2.5 |
| molybdenum | 0.3 to 1.0 |
| vanadium | 0.05 to 0.2 |
| titanium | 0.03 to 0.1 |
| aluminum | 0.01 to 0.03 |
| phosphorus | less than 0.025 |
| sulfur | less than 0.025 |
| nitrogen | at least 0.005 |
| iron | essentially balance. |

The deep hardening steel of the present invention is essentially free of nickel and copper. However it should be understood that the above described steel composition may contain small quantities of nickel and copper which are not required and are considered as incidental. In particular, up to 0.25% nickel and up to 0.35% copper may be present as residual elements in accepted commercial practice.

The term "deep hardening steel", as used herein means a steel having properties that permit a component made thereof to be hardened throughout its cross-section or as nearly throughout as possible.

The term "quenching and tempering" as used herein means a heat treatment which achieves a fully quenched microstructure. For the steel material described in the illustrative Examples A,B,C,D, and E, the heat treatment specifically includes the following steps:

1. Through heating of the workpiece or test sample to the austenizing temperature of the steel to produce a homogeneous solution throughout the section without harmful decarburization, grain growth or excessive distortion. In the below described illustrative Examples, the articles were heated to about 960° C. (1760° F.) for about one hour.
2. Fully quenching in water to produce the greatest possible depth of hardness.
3. Tempering by reheating for a sufficient length of time to permit temperature equalization of all sections. In the below described illustrative Examples, the articles were reheated to about 220° C. (428° F.) for about one hour.

The fracture toughness of all the Examples described below was measured according to ASTM Test Method E 1304, Standard Test Method for Plane-Strain (Chevron-Notch) Fracture Toughness of Metallic Materials. The specimens for the fracture toughness measurements were all cut from a larger test sample so as to have an L-T orientation with respect to the direction of rolling of the sample source material, as defined by ASTM test method E 399, Test Method for Plane-Strain Toughness of Metallic Materials.

The steel material embodying the present invention is essentially free of aluminum nitrides and, as described below in illustrative Examples C, D, and E, has a martensitic grain size of 5 or finer after quenching and tempering. As defined by ASTM Standards Designation E 112, a micro-grain size number 5 has a calculated average "diameter" of 0.06 mm (0.00236 in).

Further, as shown by the following Examples, the steel material embodying the present invention has improved fracture toughness properties and substantially the same, or better, hardenability when compared with similar prior art steel materials.

EXAMPLE A

A representative sample of a ripper tip formed of a deep hardening steel having a composition typical of that used by the assignee of the present invention for ground engaging tools, was analyzed after quenching and tempering, and found to have the following composition and properties:

| | |
|---|---|
| carbon | 0.27 |
| manganese | 0.69 |
| silicon | 1.41 |
| chromium | 1.96 |
| molybdenum | 0.34 |
| vanadium | 0.10 |
| aluminum | 0.014 |
| phosphorus | 0.027 |

-continued

| | |
|---|---|
| sulfur | 0.014 |
| boron | 0.0008 |
| nitrogen | 0.0084 |
| iron | essentially balance |
| Hardness $R_c$ | 52–53 |
| Fracture Toughness $K_{Iv}$ | 111.3 MPa$\sqrt{m}$ (101.3 ksi$\sqrt{in}$). |

The composition of the sample tool tip was determined by spectrographic analysis. The hardness measurements were taken on the surface of the tip, and fracture toughness was the average of the two specimens. The quench and temper treatment was carried out as defined above to achieve a fully quenched microstructure throughout the tip, and the hardness at depth was only slightly less than the surface hardness. The test samples had a martensitic grain size of about ASTM 1.0, equivalent to a calculated average grain diameter of 0.254 mm (0.01 in).

EXAMPLE B

A representative sample of a second ground engaging tool tip formed of a typical prior art deep hardening steel composition, similar to the composition described in Example A, was analyzed after quenching and tempering and found to have the following composition and properties:

| | |
|---|---|
| carbon | 0.27 |
| manganese | 0.64 |
| silicon | 1.65 |
| chromium | 1.98 |
| molybdenum | 0.35 |
| vanadium | 0.12 |
| aluminum | 0.007 |
| phosphorus | 0.027 |
| sulfur | 0.021 |
| boron | 0.0008 |
| nitrogen | 0.0090 |
| iron | essentially balance |
| Hardness $R_c$ | 50–51 |
| Fracture Toughness $K_{Iv}$ | 114.5 MPa$\sqrt{m}$ (104.2 ksi$\sqrt{in}$). |

As in Example A, the composition of Example B was determined by spectrographic analysis and the hardness measurements were taken on the surface of the tool tip. Likewise, the fracture toughness was the average value of two test samples. The quench and temper treatment was carried out, as defined above, to achieve a fully quenched microstructure throughout the tool tip, and the hardness at depth was only slightly less than the surface hardness. This sample, like that of Example A, had a martensitic grain size of about ASTM 1.0.

FIG. 1 is a photomicrograph taken at 75X of a representative section of a tool tip typical of the tips described in Examples 1 and 2. The photomicrograph shows the course grain microstructure typical of these prior art deep hardening steel materials. As shown in FIG. 1, a representative micro-grain 10 of the prior art material has a measured cross section of about 0.4 mm (0.016 in), equivalent to grain size number 0 as classified by ASTM Standards Designation E 112.

EXAMPLE C

Two experimental ingots representative of the deep hardening steel embodying the present invention were melted, poured, and rolled to about a 7:1 reduction to form a 51 mm (2.0 in) square bar.

Importantly, in the preparation of this melt, the titanium addition was made in the ladle after the aluminum addition. It has been discovered that this order of addition is essential, in combination with control of the composition, in preventing the formation of undesirable aluminum nitride in the solidified steel. Titanium has a stronger affinity for nitrogen than aluminum, and therefore, the controlled addition of a relatively small amount of titanium preferentially combines with nitrogen in the melt, forming titanium nitride With the nitrogen thus combined with titanium, there is no free nitrogen available for combining with aluminum. Further, since aluminum has a higher affinity for oxygen than titanium, the earlier addition of the aluminum protects the titanium from oxidation, thereby enabling the titanium to combine with available nitrogen.

Thus, in the present invention the formation of aluminum nitride is prevented and the formation of desirable titanium nitride, an aid to grain refinement, is promoted. Fine grain size, a characteristic of the present invention, significantly contributes to the improved fracture toughness properties of the deep hardening steel material.

After rolling, a 25.4 mm (1 in) diameter rod having a circular cross section was cut from each of the two rolled bars. The rod samples were heat treated according to the above defined quench and temper operation, and then machined to provide standard fracture toughness test specimens in accordance with ASTM E 1304.

The steel material representative of these ingots was analyzed and tested and found to have the following composition and physical properties:

| | |
|---|---|
| carbon | 0.28 |
| manganese | 0.61 |
| silicon | 1.51 |
| chromium | 1.80 |
| molybdenum | 0.37 |
| vanadium | 0.10 |
| aluminum | 0.015 |
| titanium | 0.041 |
| phosphorus | 0.003 |
| sulfur | 0.003 |
| nitrogen | 0.011 |
| iron | essentially balance |
| Hardness $R_c$ | 48 |
| Fracture Toughness $K_{Iv}$ | 191.4 MPa$\sqrt{m}$ (174.2 ksi$\sqrt{in}$). |

The hardness measurements were taken on both of the prepared test specimens, after quenching and tempering, at a point about 12.7 mm (0.5 inch) below the grip slot face end of the rod specimen. The hardness values were the same for both specimens. The fracture toughness value is the average value of the two rod specimens.

Both of the rod specimens had an average martensitic grain size of about ASTM 5 to 7, equivalent to a calculated average grain diameter of from about 0.060 mm (0.00236 in) to about 0.030 mm (0.00118 in). Also, representative sections of the specimens were examined by SEM (Scanning Electron Microscope) and TEM (Transmission Electron Microscope) techniques. No aluminum nitrides were found in either specimen.

EXAMPLE D

A second experimental heat, from which three ingots representative of the deep hardening steel embodying the present invention, were poured and rolled to a 7:1 reduction similar to the experimental ingots of Example C. In the preparation of this melt, the titanium addition was also made in the ladle after the aluminum addition. After rolling, a 25.4 mm (1 in) diameter rod was cut from each ingot and heat treated according to the above defined quench and temper operation. After quenching and tempering the rod samples were machined to provide standard fracture toughness test specimens as defined above.

The steel material representative of this ingot was also spectrographically analyzed and physically tested, and found to have the following composition and properties:

| | |
|---|---|
| carbon | 0.29 |
| manganese | 0.57 |
| silicon | 1.51 |
| chromium | 1.74 |
| molybdenum | 0.37 |
| vanadium | 0.10 |
| aluminum | 0.016 |
| titanium | 0.038 |
| phosphorus | 0.005 |
| sulfur | 0.005 |
| nitrogen | 0.011 |
| iron | essentially balance |
| Hardness $R_c$ | 51 |
| Fracture Toughness $K_{Iv}$ | 158.9 MPa$\sqrt{m}$ (144.6 ksi$\sqrt{in}$). |

Hardness measurements were made of each of the three prepared test specimens after quenching and tempering at a point about 12.7 mm (0.5 inch) below the grip slot face end of the rod specimens. The hardness values were the same for all three specimens. The fracture toughness value is an average value of the three specimens.

All three of the rod specimens had a martensitic grain size of about ASTM 5 to 7, equivalent to a calculated average grain diameter of from about 0.060 mm (0.00236 in) to about 0.030 mm (0.00118 in). Representative sections of the three specimens were also examined under SEM and TEM microscopes. No aluminum nitrides were found in any of the specimens.

EXAMPLE E

A heat of a steel material representing another embodiment of the present invention was poured under conditions identical to commercial practice. As in Examples C and D, the titanium addition was made in the ladle after the aluminum addition. This material was spectrographically analyzed and had the following composition:

| | |
|---|---|
| carbon | 0.29 |
| manganese | 0.66 |
| silicon | 1.57 |
| chromium | 1.97 |
| molybdenum | 0.38 |
| vanadium | 0.096 |
| aluminum | 0.016 |
| titanium | 0.043 |
| phosphorus | 0.011 |
| sulfur | 0.006 |
| nitrogen | 0.008 |
| iron | essentially balance. |

This heat was initially cast as 715 mm (28.15 in) square ingots that were rolled and then forged to produce 51 mm (2 in) square bars. Thus, the bars from which samples were cut represented about a 200:1 reduction of the original cast ingots. Three representative samples were cut from the bars and heat treated according to the above defined quench and temper schedule. After heat treatment, the samples were machined to provide standard fracture toughness test specimens as identified above. The specimens were physically tested and found to have the following properties:

| | |
|---|---|
| Hardness $R_c$ | 51 |
| Fracture Toughness $K_{Iv}$ | 157.6 MPa $\sqrt{m}$ (143.4 ksi $\sqrt{in}$ ). |

Hardness measurements were made of each of the three prepared test specimens, after quenching and tempering, at a point about 12.7 mm (0.5 inch) below the grip slot face end of the rod specimens. The hardness values were the same for all three specimens. The fracture toughness value is an average value of the three specimens.

All three of the rod specimens had an average martensitic grain size of about ASTM 5 to 7, equivalent to a calculated average grain diameter of from about 0.030 mm (0.00236 in) to about 0.030 mm (0.00118 in). Further, the specimens were examined by SEM and TEM inspection techniques and no aluminum nitrides were found in any of the three specimens.

Figure 2:
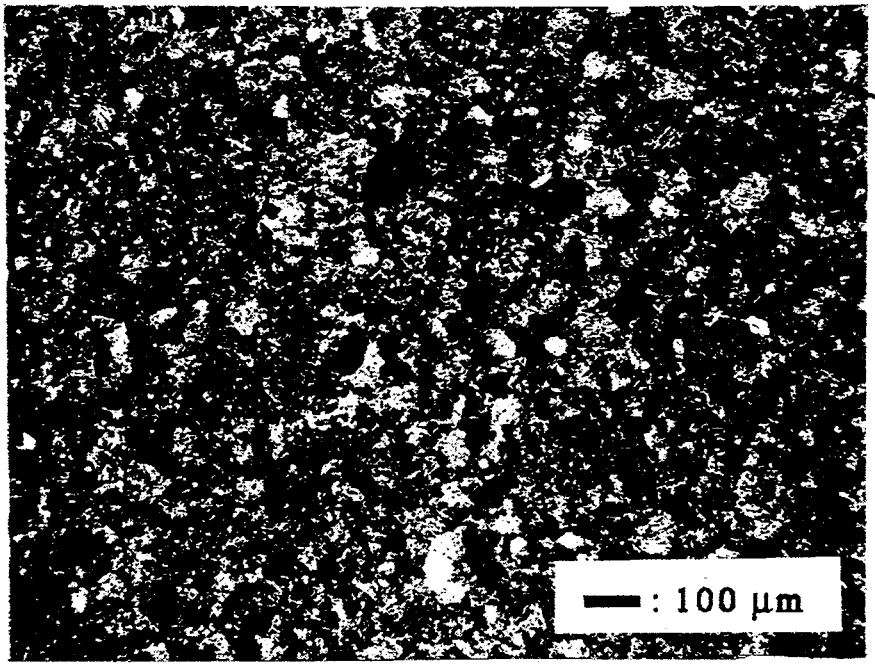
FIG. 2 is a photomicrograph, at 75X, of an etched section of a deep hardening steel according to the present invention.

FIG. 2 is a photomicrograph, taken at 75X, of a representative sample of the deep hardening steel described in this Example. As shown in FIG. 2, the microstructure of the deep hardening steel embodying the present invention has a significantly finer grain structure than that of the prior art deep hardening steel shown in FIG. 1. For example, a representative martensitic grain, represented by the reference number 12, has a cross section of about 0.027 mm (0.00105 in), whereas the prior art grain 10, shown in FIG. 1 has a cross section of about 0.4 mm (0.016 in). Preferably, the microstructure of the deep hardening steel material embodying the present invention has a grain structure in which the calculated diameter of an average grain is smaller than 0.06 mm (0.00236 in), categorized as ASTM Size Number 5.0.

Figure 3:
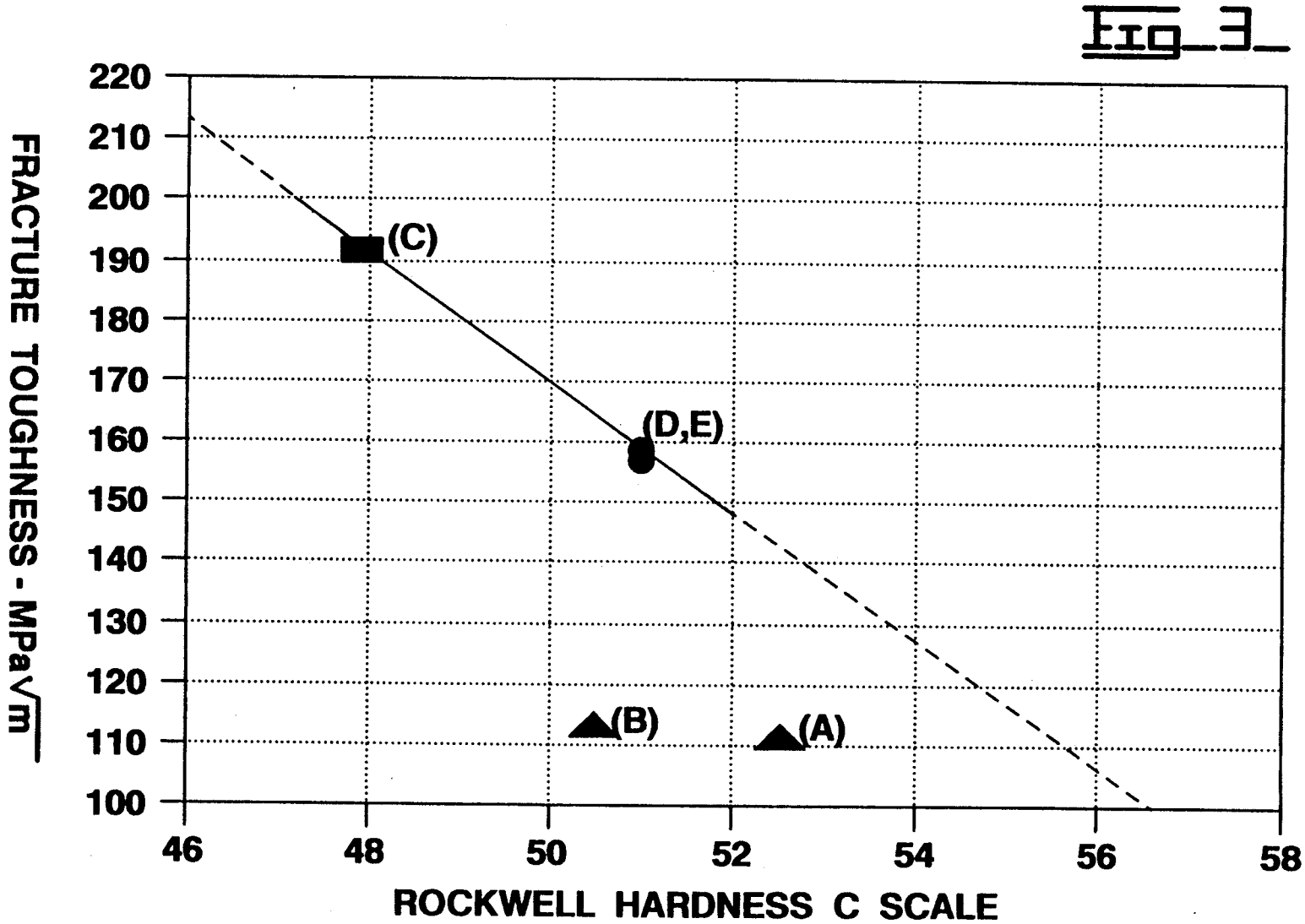
FIG. 3 is a graph showing the relationship between hardness and fracture toughness for the prior art steel and the steel embodying the present invention.

The respective hardness and fracture toughness values of the prior art deep hardening steel described in Examples A and B, and the deep hardening steel embodying the present invention described in Examples C, D, and E, are graphically shown in FIG. 3. The improvement in fracture toughness over the prior art material, in similar hardness ranges, is very apparent. The prior art material is known to have good temper resistance properties. Because of the similarity in base chemistries, in particular in chromium and molybdenum, it is expected that the steel embodying the present invention will have at least as beneficial temper resistance properties as the prior art steel.

To assure sufficient hardenability and yet not adversely affect toughness properties, carbon should be present, in the composition of the steel embodying the present invention, in a range of from about 0.26% to about 0.37%, by weight, and preferably from about 0.26% to about 0.31%, by weight.

The subject deep hardening steel also requires manganese in an amount of at least 0.5% by weight, and no more than 1.0%, preferably no more than 0.7%, by weight to assure sufficient toughness.

Chromium should be present in the subject steel composition in an amount of at least 1.5%, preferably about 1.6%, by weight, and no more than 2.5%, preferably about 2.0%, by weight to provide sufficient temper resistance and hardenability.

The subject steel should contain at least 1.0%, and preferably about 1.45%, by weight, of silicon to provide sufficient temperature resistance. For that purpose, no more than 3.0%, and preferably no more than about 1.80%, by weight, is required.

Molybdenum should also be present in the subject steel composition in an amount of at least 0.30% to further assure temper resistance and hardenability. No more than 1.0%, and preferably no more than about 0.40% is sufficient to assure that the values of these properties will be beneficially high.

It is also desirable that a small amount of vanadium be included in the composition of the subject steel composition to further promote temper resistance and secondary hardening, in combination with molybdenum. For this purpose, vanadium should be present in an amount of at least 0.05%, and preferably about 0.07%, by weight. The beneficial contribution of vanadium is accomplished with the presence of no more than 0.2%, preferably about 0.12%, by weight, in the steel.

The steel composition embodying the present invention must have small, but essential, amounts of both aluminum and titanium. Furthermore, as described above in Example C, it is imperative that the addition of titanium be made to the melt after the addition of aluminum to prevent the formation of undesirable aluminum nitrides. At least about 0.01% aluminum and about 0.03% titanium is required to provide beneficial amounts of these elements. To assure the desirable interaction of these elements with oxygen, and particularly with nitrogen, aluminum should be limited to no more than 0.03%, and preferably about 0.02%, by weight, and titanium should be limited to no more than 0.1%, preferably about 0.05%, by weight.

To assure that there is sufficient nitrogen to combine with titanium to form titanium nitride, it is extremely important that the steel composition have at least 0.005%, by weight, nitrogen. Preferably the nitrogen content is between about 0.008% to 0.012%, by weight. Also, it is desirable that normal electric furnace steelmaking levels of oxygen, i.e., about 0.002% to 0.003%, be attained.

It is also desirable that the steel embodying the present invention contain no more than 0.025%, by weight, phosphorus and sulfur to assure that these elements do not adversely affect the toughness properties of the material. Preferably, the composition contains no more than 0.010% sulfur and no more than 0.015% phosphorus.

In summary, the above examples demonstrate that a significant increase in the fracture toughness of a deep hardening steel can be achieved by the controlled addition of relatively small, but essential, amounts of aluminum and titanium. The mechanism by which the combination of relatively small amounts of these elements beneficially cooperate to refine the microstructure and improve toughness, without a decrease in hardness, is described in Example C. The deep hardening steel composition embodying the present invention is also characterized by having a fine grained microstructure, i.e., ASTM grain size number 5.0 or finer, and is free of any detrimental aluminum nitrides.

Industrial Applicability

The deep hardening steel of the present invention is particularly useful in applications requiring tools that are subject to severe wear, or abrasion, and are also subject to breakage. Examples of such tools include ground engaging implements used in construction, such as ripper tips, bucket teeth, cutting edges and mold board blades.

Further, the deep hardening steel described herein is economical to produce and does not require relatively high amounts, i.e., 3% or more, of chromium nor the inclusion of nickel or cobalt in the composition. Further, the deep hardening steel material embodying the present invention responds to conventional quenching and tempering operations. Articles formed of this material do not require specialized equipment or heat treatment to provide high hardness, temper resistance and toughness in the treated article.

Other aspects, features and advantages of the present invention can be obtained form a study of this disclosure together with the appended claims.

I claim:

1. A deep hardening steel article having a composition comprising, by weight percent, from 0.26 to 0.37 carbon, from 0.5 to 1.0 manganese, from 1.0 to 3.0 silicon, from 1.5 to 2.5 chromium, from 0.3 to 1.0 molybdenum, from 0.05 to 0.2 vanadium, from 0.03 to 0.1 titanium, from 0.01 to 0.03 aluminum, less than 0.025 phosphorous, less than 0.025 sulfur, from 0.005 to about 0.013 nitrogen, and the balance essentially iron, said steel article being free of any detrimental aluminum nitride and having, after quenching and tempering, a microstructure in which the grain size is smaller than 0.06 mm (0.00236 in).

2. A deep hardening steel article, as set forth in claim 1, wherein said composition comprises, by weight percent, 0.26 to 0.31 carbon, 0.5 to 0.7 manganese, 1.45 to 1.8 silicon, 1.6 to 2.0 chromium, 0.3 to 0.4 molybdenum, 0.07 to 0.12 vanadium, 0.03 to 0.05 titanium, 0.01 to 0.02 aluminum, less than 0.015 phosphorus, less than 0.010 sulfur, 0.008 to 0.013 nitrogen, and the balance essentially iron.

3. A deep hardening steel article, as set forth in claim 2, wherein said steel article after quenching and tempering, has a hardness of at least $R_c46$ at the middle of a section having a thickness of no more than 25.4 mm (1 in), and a plane strain fracture toughness of at least 130 $MPa\sqrt{m}$ (118.3 $ksi\sqrt{in}$).

4. A deep hardening steel article, as set forth in claim 2, wherein said steel article after quenching and tempering, has a hardness of a least than $R_c46$ measured at 12.7 mm (0.5 in) below a surface of a section having a thickness greater than 25.4 mm (1 in), and a plane strain fracture toughness of at least 130 $MPa\sqrt{m}$ (118.3 $ksi\sqrt{in}$).

5. A deep hardening steel article having a composition comprising, by weight percent, from 0.26 to 0.37 carbon, from 0.5 to 1.0 manganese, from 1.0 to 3.0 silicon, from 1.5 to 2.5 chromium, from 0.1 molybdenum, from 0.05 to 0.2 vanadium, from 0.03 to 0.1 titanium, from 0.01 to 0.03 aluminum, less than 0.025 phosphorous, less than 0.025 sulfur, from 0.005 to about 0.013 nitrogen, and the balance essentially iron, said steel having, after quenching and tempering, a hardness of at least $R_c46$ at the middle of a section having a thickness of no more than 25.4 mm (1 in), and a plane strain fracture toughness of at least 130 $MPa\sqrt{m}$ (118.3 $ksi\sqrt{in}$).

6. A deep hardening steel article, as set forth in claim 5, wherein said steel article is free of and detrimental aluminum nitride and, after quenching and tempering, has a microstructure in which the grain size is smaller than 0.06 mm (0.00236 in).

7. A deep hardening steel article, as set forth in claim 5, wherein said composition comprises, by weight percent, 0.26 to 0.31 carbon, 0.5 to 0.7 manganese, 1.45 to 1.8 silicon, 1.6 to 2.0 chromium, 0.3 to 0.4 molybdenum, 0.07 to 0.12 vanadium, 0.03 to 0.05 titanium, 0.01 to 0.02 aluminum, less than 0.015 phosphorus, less than 0.010 sulfur, 0.008 to 0.013 nitrogen, and the balance essentially iron.

8. A deep hardening steel article having a composition comprising, by weight percent, from 0.26 to 0.37 carbon, from 0.5 to 1.0 manganese, from 1.0 to 3.0 silicon, from 1.5 to 2.5 chromium, from 0.3 to 1.0 molybdenum, from 0.05 to 0.2 vanadium, from 0.03 to 0.1 titanium, from 0.01 to 0.03 aluminum, less than 0.025 phosphorous, less than 0.025 sulfur, from 0.005 to about 0.013 nitrogen, and the balance essentially iron, said steel article having, after quenching and tempering, a hardness of at least $R_c46$ measured at 12.7 mm (0.5 in) below a surface of a section having a thickness greater than 25.4 mm (1 in), and a plane strain fracture toughness of at least 130 $MPa\sqrt{m}$ (118.3 $ksi\sqrt{in}$).

9. A deep hardening steel article, as set forth in claim 8, wherein said steel article is substantially free of aluminum nitride and has, after quenching and tempering, a microstructure in which the grain size is smaller than 0.06 mm (0.00236 in).

10. A deep hardening steel article, as set forth in claim 8, wherein said composition comprises, by weight percent, 0.26 to 0.31 carbon, 0.5 to 0.7 manganese, 1.45 to 1.8 silicon, 1.6 to 2.0 chromium, 0.3 to 0.4 molybdenum, 0.07 to 0.12 vanadium, 0.03 to 0.05 titanium, 0.01 to 0.02 aluminum, less than 0.015 phosphorus, less than 0.010 sulfur, 0.008 to 0.013 nitrogen, and the balance essentially iron.

* * * * *

UNITED STATES PATENT AND TRADEMARK OFFICE

CERTIFICATE OF CORRECTION

PATENT NO. : 5,131,965

DATED : July 21, 1992

INVENTOR(S) : Joseph E. McVicker

It is certified that error appears in the above-identified patent and that said Letters Patent is hereby corrected as shown below:

In claim 5, column 10, line 6, after "chromium," delete "from 0.1 molybdenum," and add --from 0.3 to 1.0 molybdenum,--.

In claim 5, column 10, line 10, after "steel" add --article--.

In claim 6, column 10, line 16, after "of" delete "and".

Signed and Sealed this

Twenty-sixth Day of October, 1993

*Attest:*

Bruce Lehman

BRUCE LEHMAN

*Attesting Officer*

*Commissioner of Patents and Trademarks*